US008800415B2

(12) United States Patent
Osborne

(10) Patent No.: US 8,800,415 B2
(45) Date of Patent: Aug. 12, 2014

(54) TRANSFER MECHANISM FOR SHEET MATERIAL DISPENSER

(75) Inventor: Charles Agnew Osborne, Cumming, GA (US)

(73) Assignee: Solaris Paper, Inc., Alpharetta, GA (US)

( * ) Notice: Subject to any disclaimer, the term of this patent is extended or adjusted under 35 U.S.C. 154(b) by 299 days.

(21) Appl. No.: 13/441,498

(22) Filed: Apr. 6, 2012

(65) Prior Publication Data

US 2012/0255413 A1 Oct. 11, 2012

Related U.S. Application Data

(60) Provisional application No. 61/472,303, filed on Apr. 6, 2011.

(51) Int. Cl.
*B26D 5/20* (2006.01)

(52) U.S. Cl.
USPC ..... 83/62; 83/66; 83/76.7; 83/369; 225/10

(58) Field of Classification Search
USPC ..... 83/62, 66, 76.7, 369, 42, 649; 242/560.1; 225/10–16
See application file for complete search history.

(56) References Cited

U.S. PATENT DOCUMENTS

| | | | | |
|---|---|---|---|---|
| 2,930,663 | A | 3/1960 | Weiss | |
| 3,017,131 | A | 1/1962 | Wooster | |
| 3,269,592 | A | 8/1966 | Slye et al. | |
| 3,288,387 | A | 11/1966 | Craven, Jr. | |
| 3,628,743 | A | 12/1971 | Bastian et al. | |
| 3,858,951 | A | 1/1975 | Rasmussen | |
| 3,917,191 | A | 11/1975 | Graham, Jr. et al. | |
| 4,165,138 | A | 8/1979 | Hedge et al. | |
| 4,378,912 | A | 4/1983 | Perrin et al. | |
| 4,712,461 | A * | 12/1987 | Rasmussen | 83/334 |
| 5,131,302 | A * | 7/1992 | Watanabe | 83/62 |
| 5,526,973 | A * | 6/1996 | Boone et al. | 225/34 |
| 5,604,992 | A * | 2/1997 | Robinson | 34/90 |
| 5,857,393 | A * | 1/1999 | Kohiyama | 83/76.1 |
| 6,354,533 | B1 | 3/2002 | Jespersen | |
| 6,736,348 | B1 * | 5/2004 | Formon et al. | 242/560.1 |
| 7,296,765 | B2 | 11/2007 | Rodrian | |
| 7,698,980 | B2 | 4/2010 | Morris et al. | |
| 7,845,593 | B2 * | 12/2010 | Formon et al. | 242/560.1 |
| 7,963,475 | B2 | 6/2011 | Rodrian | |
| 7,967,235 | B2 * | 6/2011 | Forman et al. | 242/560 |
| 7,980,506 | B2 * | 7/2011 | Kling et al. | 242/560 |

(Continued)

FOREIGN PATENT DOCUMENTS

| | | |
|---|---|---|
| EP | 1097665 | 5/2001 |
| EP | 2377442 | 10/2011 |
| JP | 2010233971 | 10/2010 |

*Primary Examiner* — Sean Michalski
(74) *Attorney, Agent, or Firm* — Fish & Tsang, LLP

(57) ABSTRACT

A dispenser for sequentially dispensing rolls of sheet material is described. The dispenser has an automatic transfer mechanism for transferring a reserve roll into a dispensing position once a primary roll has been depleted. The automatic transfer mechanism includes a diameter sensing member and a blocker rotatably coupled to the dispenser housing and biased to rotate in a opposite directions. The diameter sensing member and block cooperate with one another in order to block the reserve roll from contacting a drive roller until the primary roll has been depleted. The reserve roll held in the dispenser by two pivoting arms that are biased to rotate towards the drive roller.

20 Claims, 6 Drawing Sheets

(56) References Cited

U.S. PATENT DOCUMENTS

| | | | | |
|---|---|---|---|---|
| 7,987,756 | B2 * | 8/2011 | Lewis et al. | 83/338 |
| 8,083,170 | B2 | 12/2011 | Troutman et al. | |
| 8,418,950 | B2 * | 4/2013 | Hagleitner | 242/560.3 |
| 8,439,293 | B2 * | 5/2013 | Hagleitner | 242/560.3 |
| 8,448,890 | B2 * | 5/2013 | Hagleitner | 242/560.1 |
| 2008/0245922 | A1 | 10/2008 | Fellhoelter | |

* cited by examiner

FIG. 7
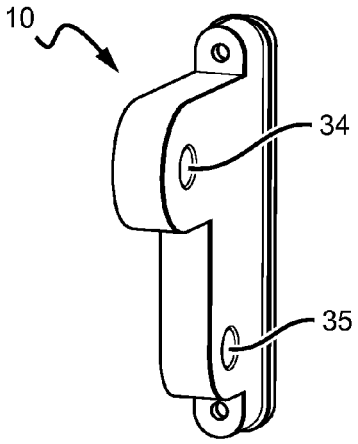
FIG. 8
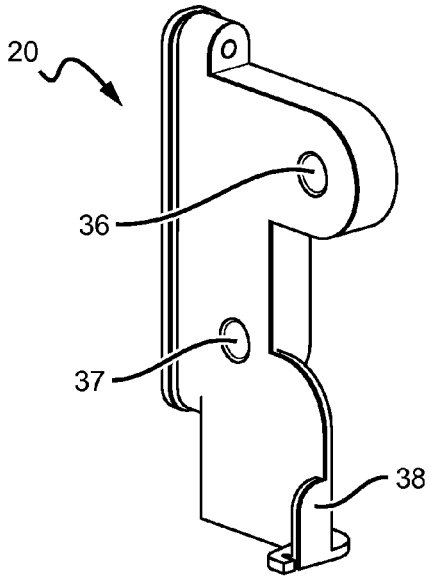
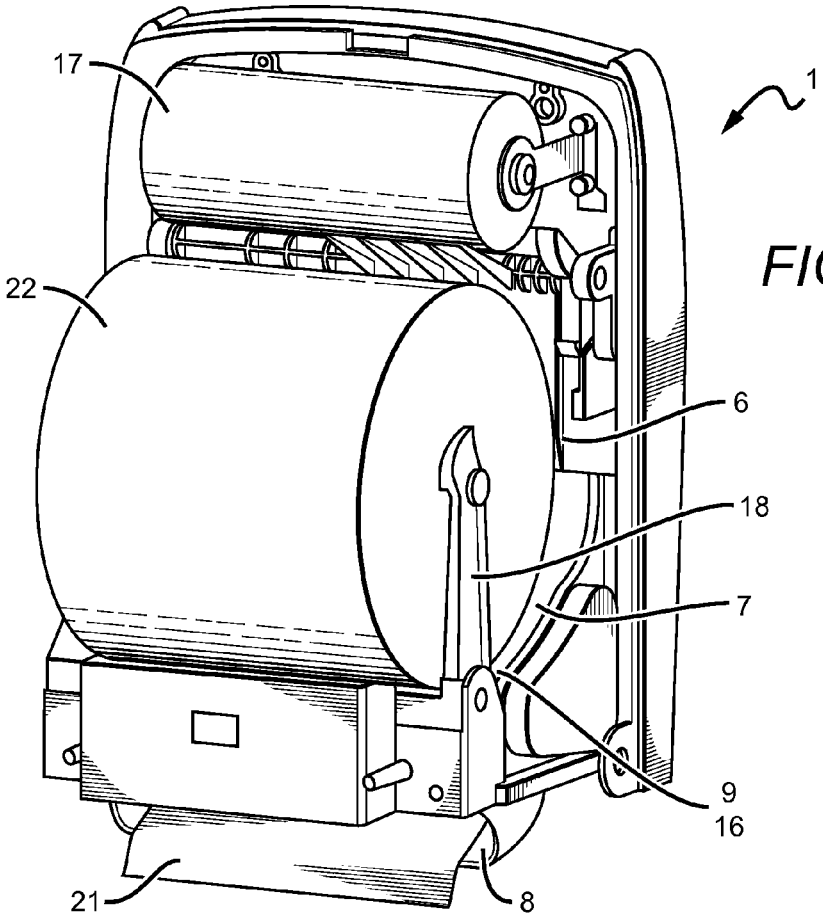
FIG. 9

TRANSFER MECHANISM FOR SHEET MATERIAL DISPENSER

This application claims the benefit of priority to provisional application Ser. No. 61/472,303 filed on Apr. 6, 2011.

FIELD OF THE INVENTION

The field of the invention is sheet material dispensers for sequentially dispensing multiple rolls of sheet material.

BACKGROUND

Dispensers for sequentially dispensing multiple rolls of sheet material are generally known. U.S. Pat. No. 3,288,387 to Craven, for example, describes a sheet material dispenser that has a sensor for sensing the depletion of a first roll and a gripping member coupled with the sensor. The sensor is a roller that contacts the outmost winding of the first roll and is biased to move towards the center axis of the roll. When the first roll is entirely depleted, its core is exposed and the sensor roller moves into a groove in the core. This, in turn, causes the gripping member (via a linkage) to introduce the leading edge of the second roll into a feeding mechanism for dispensing. Unfortunately, the dispenser described in Craven is complex, has a high part count, and only works with "modified" roll cores (e.g., cores that have grooves or cavities).

This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

U.S. Pat. No. 3,628,743 to Bastian also describes a dispenser for sequentially dispensing multiple rolls of sheet material. Unlike, Craven, the diameter sensing roller and transfer mechanism in Bastian does not rely on a modified core. Instead, the dispenser senses a diameter size. The transfer mechanism components (e.g., rollers, linkages, springs) are configures such that an unwound portion of the second roll is introduced into a feeding mechanism once a predetermined minimum diameter is sensed. Like Craven, the dispenser in Bastian is complex, difficult to assemble, and has a high part count.

Other examples of dispensers with transfer mechanisms for sequentially dispensing multiple rolls of sheet material can be found in U.S. Pat. No. 4,165,138 to Hedge and U.S. Pat. No. 4,378,912 to Perrin. Both Hedge and Perrin describe a dispenser transfer mechanism that detects the absence of sheet material using a finger and a grooved roller that pinch an unwound portion of the first roll of sheet material. Once the first roll is depleted, the finger is allowed to enter the groove, causing a tucking device (via a linkage) to introduce the second roll of sheet material into a feed nip. Unfortunately, the finger and grooved roller introduces a significant amount of friction, making it difficult to dispense the first roll and increasing the likelihood of tearing. Furthermore, the tucking device remains between the feed mechanism after the second roll has already been fed through, which can interfere with the dispensing of the second roll of sheet material.

U.S. Pat. No. 5,526,973 to Boone, U.S. Pat. No. 7,698,980 to Morris, U.S. Pat. No. 6,354,533 to Jesperson, and U.S. Pat. No. 6,736,348 to Forman each describes a two-roll dispenser that includes a transfer mechanism that has a tucking device for introducing a second roll of sheet material into a feed mechanism. Unfortunately, these references also suffer from numerous drawbacks, including: low reliability and robustness; difficult to manufacture, assemble, and calibrate spring tension; and high part count.

Thus, there is still a need for improved dispensers for sequentially dispensing multiple rolls of sheet material.

SUMMARY OF THE INVENTION

The inventive subject matter provides apparatus, systems, and methods in which a dispenser has an automatic transfer mechanism for sequentially dispensing at least two rolls of sheet material. The dispenser has a housing with an interior space that is sized and dimensioned to store rolls of sheet material. The dispenser also has a drive roller configured to drive unwound portions of sheet material to a feed nip. The feed nip then transfers the unwound portion to an opening of the dispenser.

The automatic transfer mechanism includes: (i) a diameter sensing member movably coupled with the housing and biased to move in a first direction; and (ii) a blocker movably coupled with the housing and biased to move in a second direction. The diameter sensing member has a stop that cooperates with a catch on the blocker so as to impede the blocker from moving in the second direction until the diameter sensing member has moved to a predetermined position in the first direction due to dispensing the primary roll of sheet material.

In one aspect of some embodiments, the diameter sensing member and blocker are rotatably coupled with the housing. In such embodiments, the diameter sensing member and blocker each have paddle portions that are configured to contact an outmost winding of a roll of sheet material. As used herein, "paddle" means a surface. The term "paddle" is not intended to imply any particular size or shape. As such, the term paddle includes flat and curved surfaces.

The paddle portion of the diameter sensing member is biased to rotate towards a primary roll of sheet material (i.e., in a "first direction") and the paddle portion of the blocker is biased to rotate towards a drive roller in the housing (i.e., a "second direction"). As the primary roll of sheet material is dispensed, its diameter is decreased, thus allowing the paddle portion of the diameter sensing member to rotate. Once the diameter of the primary roll is depleted to a predetermined size, the stop on the diameter sensing member moves sufficiently to disengage the catch on the blocker. The blocker then rotates towards the drive roller, allowing a reserve roll of sheet material to contact the drive roller for dispensing.

In other aspects of some embodiments, the transfer mechanism further includes a first bracket and a second bracket for movably coupling the diameter sensing member and the blocker to the housing of the dispenser. Each bracket can include two holes for rotatably receiving the ends of the diameter sensing member and the blocker.

In yet other aspects of some embodiments, the transfer mechanism includes two springs: one for biasing the diameter sensing member to move in a first direction, and the other for biasing the blocker to move in a second direction. The springs can either couple directly to the housing or indirectly to the housing (e.g., via the brackets, roll holders, or some other component within the interior space of the housing).

In one aspect of some embodiments, the housing includes two pairs of roll holders (e.g., two pairs of arms) for holding a primary roll of sheet material and a reserve roll of sheet material. The roll holders that are for holding the reserve roll of sheet material can also be movably coupled to the housing and biased to move towards the drive roller. In this manner, when the blocker catch disengages the diameter sensing member stop, the reserve roll moves towards the drive roller and allows an outmost winding of the reserve roll to contact the drive roller.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 7 is a perspective view of a left bracket for movably coupling a transfer mechanism to a dispenser housing.

FIG. 8 is a perspective view of a right bracket for movably coupling a transfer mechanism to a dispenser housing.

FIG. 9 is a perspective view of the dispenser of FIG. 1, with two rolls of sheet material loaded in the interior space of the dispenser.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

It should be noted that during the discussion of the different figures, one skilled in the art could vary the design for based on current manufacturing technology or materials and still stay within the spirit and scope of the present invention.

Figure 1:
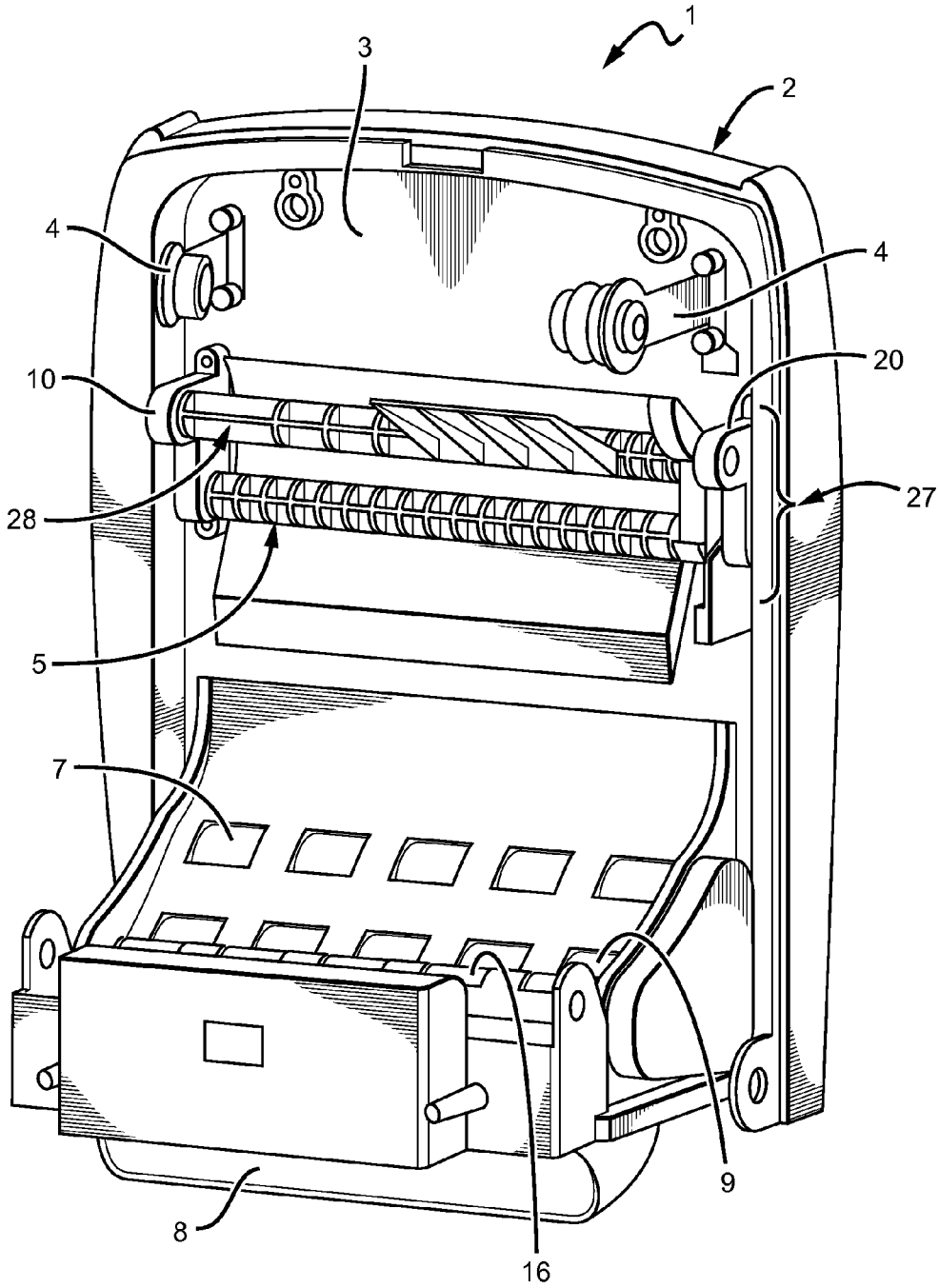
FIG. 1 is a perspective view of the internal workings of an empty sheet material dispenser, showing one embodiment of a transfer mechanism.

FIG. 1 shows a dispenser 1 for sequentially dispensing two rolls of sheet material. Dispenser 1 generally comprises a rear housing 2 and a front cover 39 (see FIG. 11) removably coupled together. In FIG. 1 front cover 39 has been removed to show the internal components of dispenser 1. Attached to the interior wall 3 of rear housing 2 is a first pair of roll holders 4 for holding a primary roll of sheet material in a primary position. Interior wall 3 further includes a second pair of roll holders 18 (see FIG. 2) for holding a reserve roll of sheet material in a reserve position. As used herein, "primary roll" simply means a roll whose diameter can trigger a transfer mechanism for dispensing another roll (i.e., a "reserve roll"). Furthermore, "primary position" and "reserve position" simply refer to the positions of the primary roll and the reserve roll, respectively, in relation to a transfer mechanism. The term "primary roll" is not intended to imply that the roll must be dispensed before a reserve roll can be dispensed. Those of skill in the art will appreciate that the structure of dispenser 1 allows rolls of sheet material to be manually loaded and independently dispensed from either the top position or the bottom position, in any order desired by a user.

Dispenser 1 also has a transfer mechanism 27 comprising a diameter sensing member 28, a blocker 5, a left bracket 10 and a right bracket 20. Transfer mechanism 27 functions by sensing the diameter of the primary roll of sheet material and transferring a reserve roll of sheet material onto drive roller 7 upon depletion of the primary roll. The interaction between diameter sensing member 28 and blocker 5 will be discussed in more detail in conjunction with FIGS. 3-7.

Dispenser 1 also has a feed nip comprising a pair of parallel rollers, rear roller 9 and front roller 16. Feed nips are well known and all variations suitable for grabbing a leading edge of a roll of sheet material are contemplated. Rollers 9 and 16 cooperate with drive roller 9 to dispense sheet material from opening 8 of rear housing 2.

Those of skill in the art will appreciate that the relative positions of the primary roll and secondary roll can be altered from the positions shown in FIG. 1. For example, drive roller 7 and transfer mechanism 27 could be repositioned and reconfigured such that the reserve roll position is located on top and the primary roll position is located on the bottom (or side-to-side, diagonally, or any other desired orientation).

Figure 2:
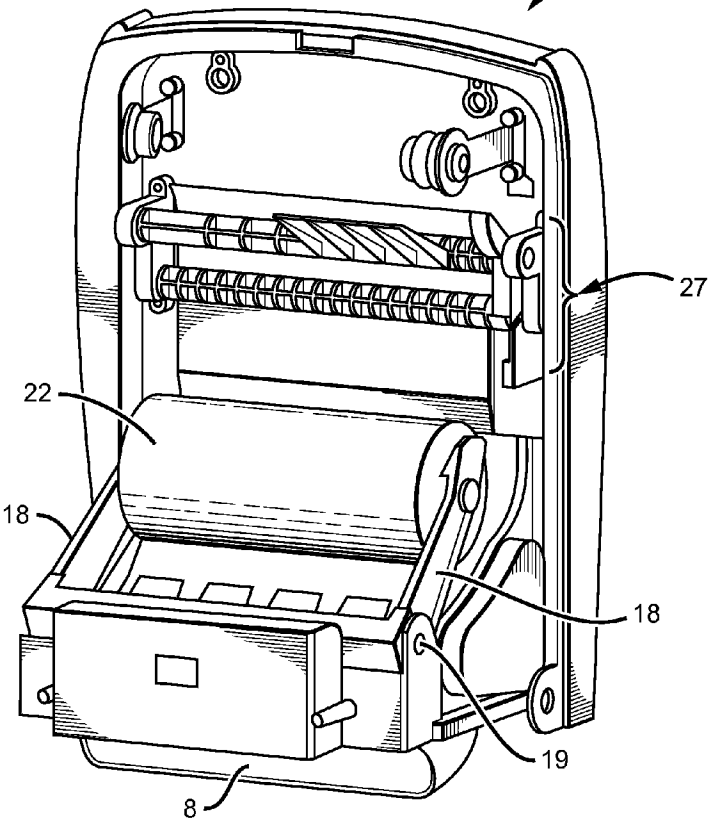
FIG. 2 is a perspective view of the dispenser of FIG. 1, with a roll of sheet material loaded in the reserve position.

FIG. 2 shows dispenser 1 with a reserve roll 22 loaded in the reserve position via roll holders 18. Roll holders 18 are pivotally coupled with rear housing 2 via pivoting frame 19. Roll holders 18 are biased to rotate such that roll 22 rests on drive roller 7. Alternatively, pivoting frame 19 could be replaced with a track frame for translatably coupling roll holders 18 with rear housing 2. Roll holders 18 can be biased to move towards driver roll 7 using a spring, gravity (in combination with a proper positioning of the center of mass of roll 22), or any other means suitable for applying a force.

Since roll 22 is in direct contact with drive roller 7, roll 22 will be dispensed out of opening 8 as driver roll 7 spins. Drive roller 7 is spun via a motor (not shown) and motion sensor 24. When motion sensor 24 senses motion, it sends a signal to the motor and the motor spins drive roller 7 and rollers 9, 16 at a predetermined speed and for a predetermined time. A control system can be coupled with the motor in order to control the length of sheet material dispensed. Dispenser 1 also includes a web-cutting knife (not shown) configured to emerge from the feed nip during a dispensing cycle to cut the sheet material. In alternative embodiments, drive roller 7 is driven manually by a user.

Figure 3:
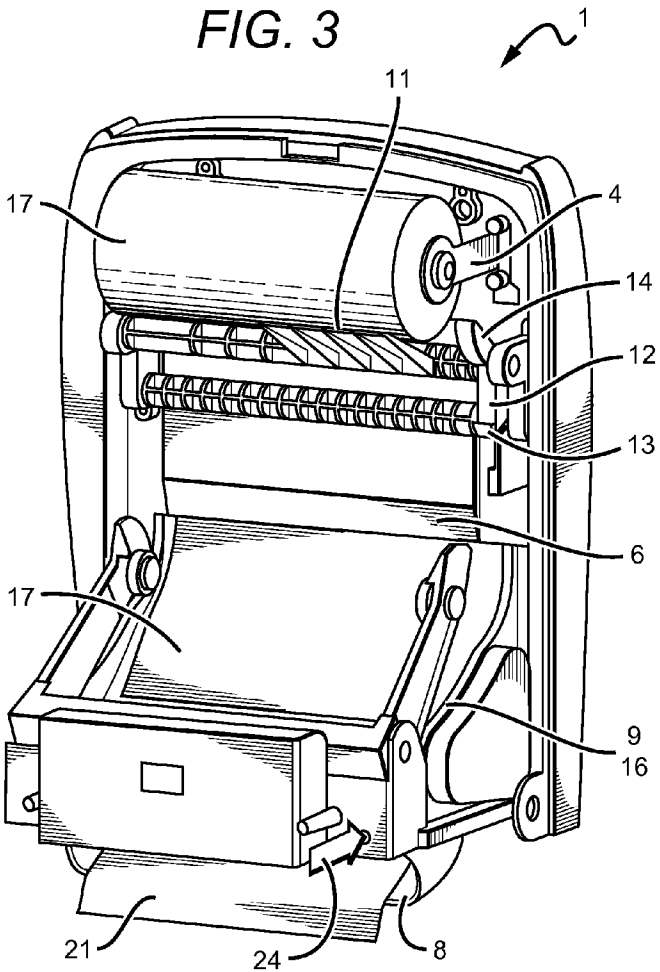
FIG. 3 is a perspective view of the dispenser of FIG. 1, with a roll of sheet material loaded in the primary position.

Once roll 22 has been depleted to about 25%, it can be manually removed from the reserve roll position and loaded into the primary roll position, as shown in FIG. 3. A roll of sheet material is loaded into the primary position by pulling down lever 14 of diameter sensing member 28 (see FIG. 4*b*) and placing the roll between roll holders 4. Lever 14 is then released, allowing paddle portion 11 of diameter sensing member 28 (see FIG. 4*a*) to rest on an outmost winding of primary roll 17 (formerly referred to as reserve roll 22). The leading edge of roll 17 is then fed behind guide 31 of blocker 5 (see FIG. 5*a*) and onto drive roller 7. Drive roller 7 then drives the leading edge into the feed nip (i.e., rollers 9, 16).

Having rotated diameter sensing member 28 away from the center axis of roll holders 4 using lever 14, stop 12 has engaged catch 13 on blocker 5 (see FIGS. 6*a* and 6*b*), causing blocker 5 to rotate away from drive roller 7. Paddle portion 6 of blocker 5 is now positioned to contact an outmost winding of new reserve roll 22 (see FIG. 9), thus preventing reserve roll 22 from contacting drive roller 7.

Figure 4A:
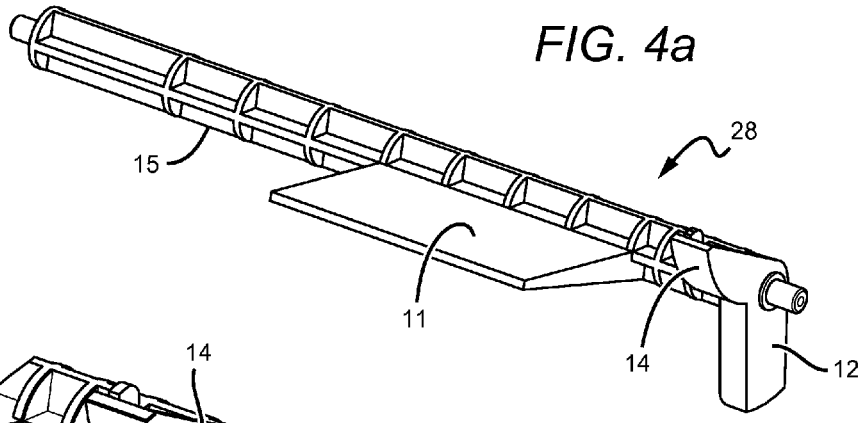
FIG. 4*a* is a perspective view of one embodiment of a diameter sensing member.
Figure 4B:
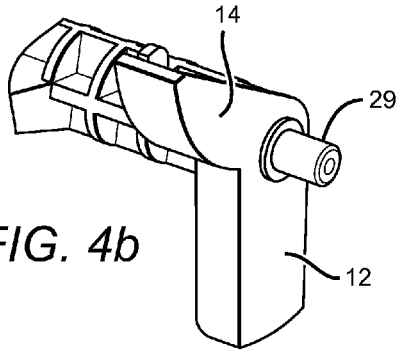
FIG. 4*b* is a close-up perspective view of the diameter sensing member of FIG. 4*a*, showing a catch.

FIGS. 4*a* and 4*b* show diameter sensing member 28 apart from dispenser 1 and transfer mechanism 27. Diameter sensing member 28 has a shaft 15, paddle portion 11, lever 14, and stop 12.

Figure 5A:
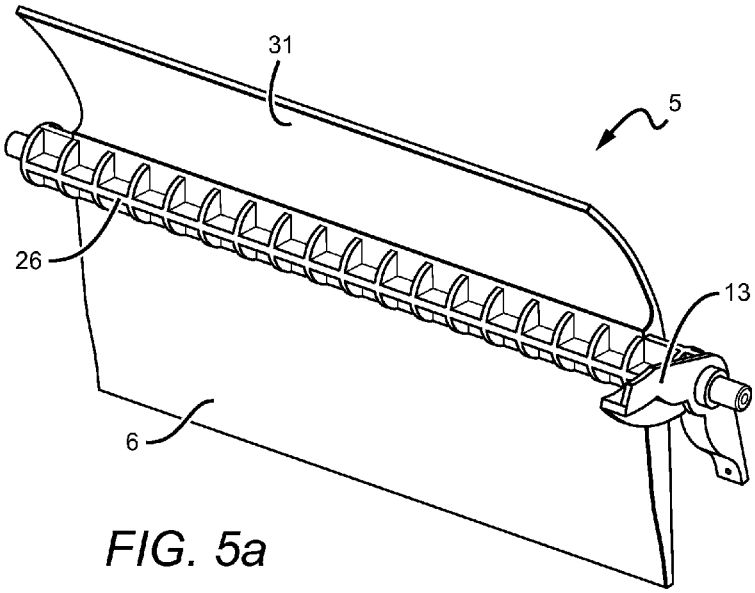
FIG. 5*a* is a perspective view of one embodiment of a blocker.
Figure 5B:
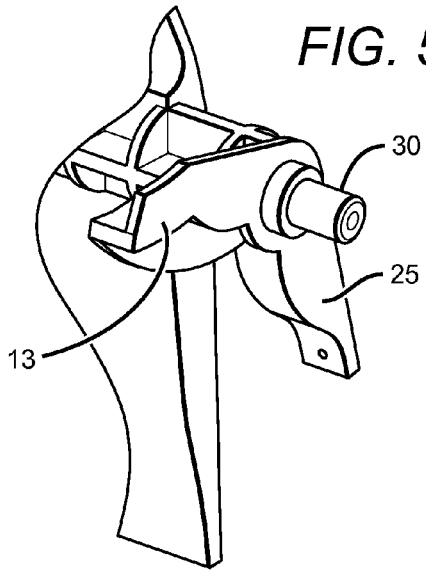
FIG. 5*b* is a close-up perspective view of the blocker of FIG. 5*a*, showing a stop.

FIGS. 5*a* and 5*b* show blocker 5 apart from dispenser 1 and transfer mechanism 27. Blocker 5 has a guide 31, shaft 26, paddle portion 6, and a catch 13.

Figure 6A:
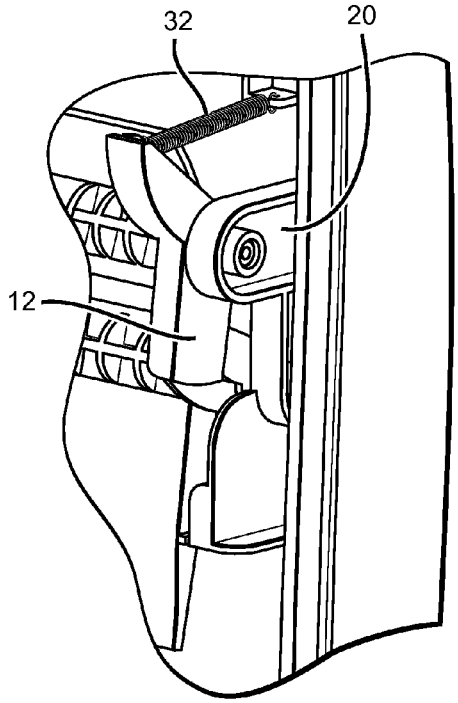
FIGS. 6*a* and 6*b* are close-up perspective views of the dispenser of FIG. 1, showing how the blocker and diameter sensing member cooperate with one another.
Figure 6B:
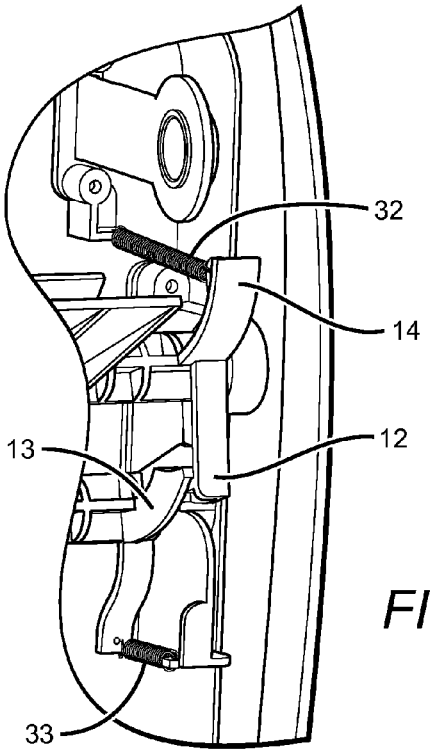

FIGS. 6*a* and 6*b* show close-up perspective views of stop 12 and catch 13. These close-up views illustrate how stop 12 and catch 13 cooperate to prevent reserve roll 22 from contacting drive roller 7 until primary roll 17 has been depleted to a predetermined size. Specifically, as diameter sensing member 28 rotates towards roll 17, stop 12 rotates upward until eventually catch 13 is "disengaged," allowing blocker 5 to rotate towards drive roller 7. Diameter sensing member 28 and blocker 5 and are biased to rotate in opposite directions (e.g., clockwise and counter clockwise) via springs 32 and 33, respectively.

FIGS. 7 and 8 show perspective views of bracket 10 and 20, respectively. Bracket 10 has holes 34 and 35 for rotatably receiving ends of diameter sensing member 28 and blocker 5. Bracket 20 has holes 36 and 37 for similar purposes. In addition, bracket 20 includes hole 38 for attaching spring 33. In alternative embodiments in which diameter sensing member 28 and blocker 5 are translatably coupled with rear housing 2, brackets 10 and 20 could include tracks.

Figure 10:
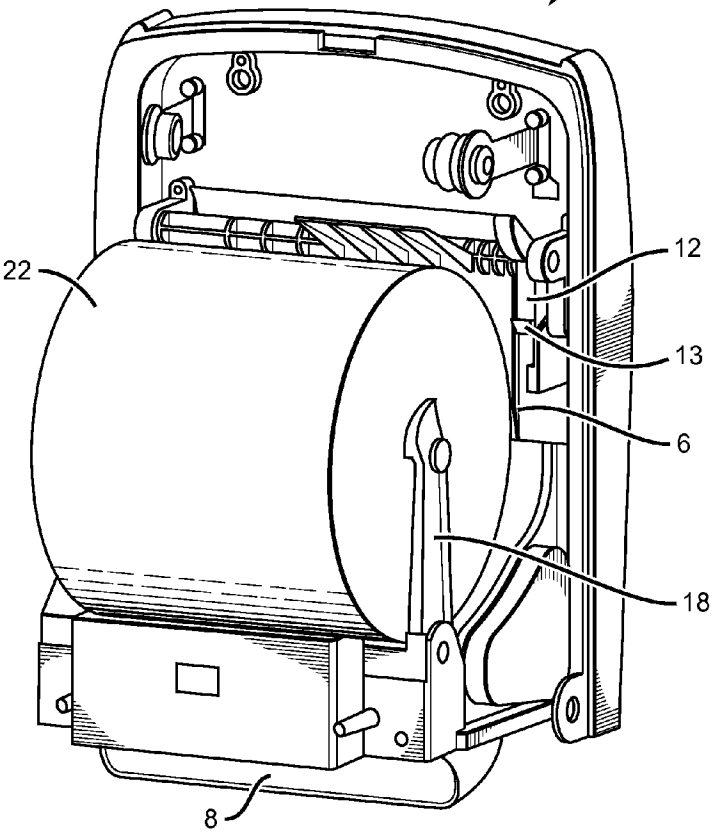
FIG. 10 is a perspective view of the dispenser of FIG. 1, with one roll of sheet material loaded in the reserve position and ready to be moved into contact with the drive roller.

FIG. 9 shows dispenser 1 with primary roll 17 and reserve roll 22 loaded therein. Paddle portion 6 of block 5 is locked into position, holding reserve roll 22 off of primary roll drive roller 7 (e.g., roll holders 18 are in a substantially vertical position), thus preventing the leading edge of reserve roll 22 from feeding into rollers 9 and 16 (shown in FIG. 3). In this configuration, primary roll 17 will dispense until reaching a predetermined diameter of depletion. When primary roll 17 has reached the predetermined diameter, stop 12 will release catch 13 and paddle portion 6 will rotate towards drive roller 7, allowing reserve roll 22 to rest on drive roller 7. FIG. 10 shows dispenser 1 with primary roll 17 completely depleted and primary roll position empty. Reserve roll 22 has its leading edge properly located within the shaded quadrant. With the proper placement of the reserve roll 22 leading edge, drive roller 7 will drive the leading edge into the feed nip for dispensing.

In the present embodiment, the primary roll compartment is sized and dimensioned to receive a roll of sheet material that has a diameter that is 25% less than the diameter of the reserve roll. In alternative embodiments, the two compartments are equally sized and dimensioned. In such embodiments, it is not necessary for a technician (e.g., facilities manager, janitor, etc) to transfer the reserve roll to the primary roll position upon depletion to less than 25%. Rather, two full rolls of sheet material can be simultaneously loaded into dispenser 1 for sequential dispensing via automatic transfer mechanism 27. However, the present invention advantageously conserves space by providing a smaller sized primary roll compartment.

Figure 11:
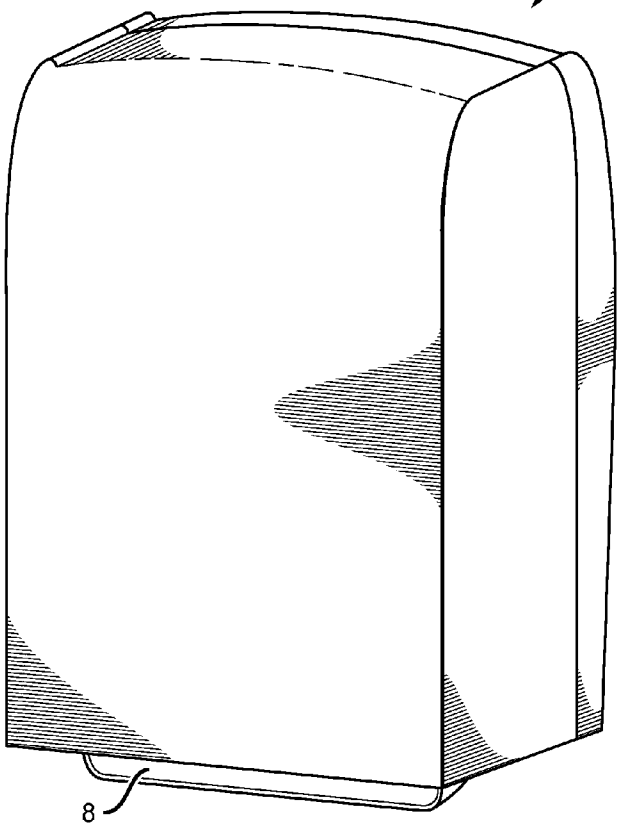
FIG. 11 is a perspective view of the dispenser of FIG. 1, showing the front cover attached to the rear housing.

FIG. 11 shows dispenser 1 with front cover 39 attached to rear housing 2. Front cover 39 is removably and rotatably coupled with rear housing 2. Together, front cover 39 and rear housing 2 define an interior space that is sized and dimensioned to store two rolls of sheet material. The present embodiment is configured to completely enclose the rolls of sheet material. Alternatively, dispenser 1 could be configured to only partially enclose the rolls of sheet material. In other embodiments, dispenser 1 is sized and dimensioned to store a third roll of sheet material. In this embodiment, dispenser 1 could additionally include a second transfer mechanism for transferring the third roll of sheet material into contact with a drive roller as a function of either the first roll diameter or the second roll diameter. Those of skill in the art will appreciate that the inventive concepts discussed herein can be applied to dispensers that hold any number of rolls of sheet material.

The present inventive subject matter provides numerous advantages over previously contemplated sequential roll dispensers. Specifically, the dispensers described herein have a low part count, are robust, easy to manufacture, cost effective, and reduce chances of tearing, among other advantages.

Unless the context dictates the contrary, all ranges set forth herein should be interpreted as being inclusive of their endpoints and open-ended ranges should be interpreted to include commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A dispenser having an automatic transfer mechanism for dispensing at least first and second rolls of sheet material, comprising:

a housing defining an interior space;

first and second roll holders at least partially disposed in the interior space and configured to releasably engage the first and second rolls;

a drive roller configured to drive the sheet material from the second roll to a feed nip;

a diameter sensing member movably coupled with the housing and biased to move in a first direction;

a blocker movably coupled with the housing and biased to move in a second direction;

wherein the diameter sensing member has a stop; and wherein the blocker has a catch that cooperates with the stop to impede the blocker from moving in the second direction until the diameter sensing member has moved to a predetermined position in the first direction due to dispensing the first roll of sheet material.

2. The dispenser of claim 1, further comprising a web-cutting knife configured to emerge from the feed nip during a dispensing cycle to cut an unwound portion of a roll of sheet material.

3. The dispenser of claim 1, wherein the first and second roll holders each comprise a pair of arms.

4. The dispenser of claim 1, wherein the second roll holder arms are pivotally coupled to the housing and biased to rotate towards the drive roller.

5. The dispenser of claim 1, wherein the feed nip comprises first and second rollers.

6. The dispenser of claim 1, wherein the diameter sensing member further comprises a shaft, a lever, and a paddle portion sized and dimensioned to contact an outmost winding of a roll of sheet material.

7. The dispenser of claim 1, wherein the drive roller is further configured to drive a leading edge of sheet material to the feed nip.

8. The dispenser of claim 1, wherein the blocker further comprises a shaft, a paddle portion configured to contact an outmost winding of a roll of sheet material, and a guide configured to guide a leading edge of sheet material to the drive roller.

9. The dispenser of claim 1, further comprising a motor coupled with the drive roller and a motion sensor, wherein the motor is configured to rotate the drive roller upon receiving a signal from the sensor.

10. The dispenser of claim 9, wherein the motor is coupled with the feed nip.

11. The dispenser of claim 10, wherein the motor is configured to dispense a pre-determined length of sheet material upon receiving a signal from the motion sensor.

12. The dispenser of claim 11, further comprising a web-cutting knife configured to emerge from the feed nip during a dispensing cycle to cut the first roll at a pre-determined length.

13. The dispenser of claim 1, further comprising a first bracket and a second bracket configured to rotatably couple the diameter sensing member and the blocker to the housing.

14. The dispenser of claim 13, wherein the first and second brackets each have first and second holes for rotatably receiving first and second ends of the diameter sensing member and the blocker.

15. The dispenser of claim 14, further comprising a first spring for biasing the diameter to rotate in the first direction and a second spring for biasing the blocker to rotate in the second direction.

16. The dispenser of claim 15, wherein the first direction and second direction are opposite of one another.

17. The dispenser of claim 16, further comprising a third spring for biasing the second roll holders to rotate towards the drive roller.

18. The dispenser of claim 1, wherein housing comprises a rear housing removably coupled with a front cover.

19. The dispenser of claim 18, wherein the front cover is rotatably coupled with the rear housing.

20. The dispenser of claim 19, wherein the rear housing has an opening for dispensing a leading edge of a roll of sheet material.

* * * * *